US007148473B2

(12) United States Patent
Yamaguchi et al.

(10) Patent No.: US 7,148,473 B2
(45) Date of Patent: Dec. 12, 2006

(54) TIME OF FLIGHT MASS SPECTROMETER

(75) Inventors: Shinichi Yamaguchi, Kyouto-fu (JP); Morio Ishihara, Osaka-fu (JP); Michisato Toyoda, Osaka-fu (JP); Daisuke Okumura, Osaka-fu (JP)

(73) Assignees: Shimadzu Corporation, Kyoto (JP); Osaka University, Osaka (JP)

( * ) Notice: Subject to any disclaimer, the term of this patent is extended or adjusted under 35 U.S.C. 154(b) by 120 days.

(21) Appl. No.: 10/929,770

(22) Filed: Aug. 31, 2004

(65) Prior Publication Data

US 2005/0045817 A1 Mar. 3, 2005

(30) Foreign Application Priority Data

Sep. 3, 2003 (JP) ..... 2003-310966

(51) Int. Cl.
*H01J 49/40* (2006.01)

(52) U.S. Cl. ..... 250/287; 250/291

(58) Field of Classification Search ..... 250/287, 250/288, 291
See application file for complete search history.

(56) References Cited

U.S. PATENT DOCUMENTS 4,707,602 A * 11/1987 Knorr ..... 250/282
6,300,625 B1 * 10/2001 Ishihara ..... 250/287
6,642,410 B1 * 11/2003 Reddy et al. ..... 562/426
6,828,553 B1 * 12/2004 Weiss ..... 250/287
6,906,321 B1 * 6/2005 Yamaguchi ..... 250/287
6,949,736 B1 * 9/2005 Ishihara ..... 250/282
6,949,738 B1 * 9/2005 Yamaguchi et al. ..... 250/287
6,998,606 B1 * 2/2006 Buttrill, Jr. ..... 250/287
2005/0017169 A1 * 1/2005 Yamaguchi ..... 250/288
2005/0077461 A1 * 4/2005 Yamaguchi et al. ..... 250/287
2005/0077462 A1 * 4/2005 Yamaguchi et al. ..... 250/287
2005/0103992 A1 * 5/2005 Yamaguchi et al. ..... 250/287
2005/0151076 A1 * 7/2005 Yamaguchi et al. ..... 250/291
2005/0194528 A1 * 9/2005 Yamaguchi et al. ..... 250/287
2005/0247869 A1 * 11/2005 Yamaguchi ..... 250/287

FOREIGN PATENT DOCUMENTS

JP 11-135061 5/1999
JP 11-195398 7/1999
JP 11-297267 10/1999

* cited by examiner

*Primary Examiner*—David A. Vanore
(74) *Attorney, Agent, or Firm*—Westerman, Hattori, Daniels & Adrian, LLP.

(57) ABSTRACT

In a time of flight mass spectrometer (TOF-MS) of the present invention, a flight controller makes ions fly a loop orbit a predetermined number of turns, and an ion detector detects the ions at each turn of the flight. A flight time measurer measures the length of flight time of ions of a same mass to charge ratio at every turn, and a data processor constructs a spectrum of flight time. The data processor further computes the Fourier transformation of the spectrum, and determines the mass to charge ratio of the ions based on a frequency peak appearing in the Fourier transformation.

11 Claims, 3 Drawing Sheets

TIME OF FLIGHT MASS SPECTROMETER

The present invention relates to a time of flight mass spectrometer (TOF-MS), and especially to one in which ions repeatedly fly a loop orbit or a reciprocal path.

BACKGROUND OF THE INVENTION

In a TOF-MS, ions accelerated by an electric field are injected into a flight space where no electric field or magnetic field is present. The ions are separated by their mass to charge ratios according to the time of flight until they reach and are detected by a detector. Since the difference of the lengths of flight time of two ions having different mass to charge ratios is larger as the flight path is longer, it is preferable to design the flight path as long as possible in order to enhance the resolution of the mass to charge ratio of a TOF-MS. In many cases, however, it is difficult to incorporate a long straight path in a TOF-MS due to the limited overall size, so that various measures have been taken to effectively lengthen the flight length.

In the Japanese Unexamined Patent Publication No. H11-297267, an elliptic orbit is formed using plural toroidal type sector-formed electric fields, and the ions are guided to fly on the elliptic orbit repeatedly many times, whereby the effective flight length is elongated. In the Japanese Unexamined Patent Publication Nos. H11-135061 and H11-195398, ions fly on an "8" figured orbit repeatedly. In these TOF-MSs, the length of flight time of ions from the time when they start the ion source and to the time when they arrive at and are detected by the ion detector is measured, where the ions fly the closed orbit a predetermined times between the ion source and the ion detector. The mass to charge ratios of the ions are calculated based on the lengths of the flight time. As the number of turns the ions fly the orbit is larger, the length of flight time is longer, so that the resolution of the mass to charge ratio becomes better by increasing the number of turns.

In an ideal TOF-MS, ions of the same mass to charge ratio start at the same starting point with the same initial energy, and arrive at the ion detector together at the same time. But in an actual TOF-MS, diversity in the initial kinetic energy of ions of the same mass to charge ratio, difference in the starting point, variation in the starting time (jitter), variation in the detection timing (jitter), fluctuation of the source voltage, etc. cause errors in the measured length of the flight time. Since these error-causing factors are unrelated to mass to charge ratio of ions, the length of flight time is not exactly the function of the mass to charge ratio, and the errors of the flight time cannot be eliminated or decreased by increasing the number of turns that the ions fly the loop orbit. This prevents improving the accuracy of the mass analysis in such type of TOF-MSs.

SUMMARY OF THE INVENTION

An object of the present invention is therefore to improve the accuracy of TOF-MSs by eliminating or decreasing errors caused by factors unrelated to the mass to charge ratio of ions.

According to the present invention, a time of flight mass spectrometer (TOF-MS) includes:

a flight space containing a loop orbit on which an ion flies;

a flight controller for making an ion fly the loop orbit a predetermined number of turns;

an ion detector for detecting an ion flying or having flown the loop orbit;

a flight time measurer for measuring a length of flight time of ions of a same mass to charge ratio at or after every turn; and a data processor for constructing a spectrum of flight time, for computing a Fourier transformation of the spectrum, and for determining the mass to charge ratio of the ions based on a frequency peak appearing in the Fourier transformation.

The "loop orbit" of the present invention may be shaped circular, like the figure "8", or in any other form of a closed line.

Instead of the loop orbit, a reciprocal path can be used. In this case, the TOF-MS of the present invention includes:

a flight space containing a reciprocal path on which an ion flies;

a flight controller for making an ion fly the reciprocal path a predetermined number of turns;

an ion detector for detecting an ion flying or having flown the reciprocal path;

a flight time measurer for measuring a length of flight time of ions of a same mass to charge ratio at or after every turn; and a data processor for constructing a spectrum of flight time, for computing a Fourier transformation of the spectrum, and for determining the mass to charge ratio of the ions based on a frequency peak appearing in the Fourier transformation.

In the TOF-MS of the present invention, the data processor constructs a flight time spectrum based on the signals generated by the detector at every turn of the flying ions, where each signal represents the lengths of flight time at every turn. In the flight time spectrum, peaks of an ion having a mass to charge ratio m appear at almost regular interval of the cycle time of the ion to fly the loop orbit. The cycle time depends on the speed of the ion, and is not affected by the deviation in the starting time at the ion source, or by the deviation in the detecting time at the detector. When the Fourier transformation of the flight time spectrum is computed, the cycle time is converted to a frequency peak. Since the speed of the ion depends on its mass to charge ratio, the frequency corresponds to the mass to charge ratio. Even when ions of different mass to charge ratios are mixed and accordingly various peaks appear mixedly in the flight time spectrum, the frequencies clearly appear in its Fourier transformation, and the mass to charge ratios of the ions can be respectively and independently determined.

In one mode of the present invention, the ion detector is placed on the loop orbit, or on the reciprocal path, and detects the flying ion non-destructively or almost non-destructively at every turn of the ion after it is ejected from the ion source.

If an electromagnetic detector for detecting the electric charge of a passing ion is used, an ion can be detected purely non-destructively, so that an ion can be detected principally without limitation of the number of turns. If such a detecting mechanism is used that a part of the group of passing ions is separated and led to a normal ion detector, the number of ions decreases as the ions turn the loop orbit or the reciprocal path, so that the number of turns is limited. But within such a limitation, a flight time spectrum can be constructed for one ejection of ions. This saves the measuring time and is advantageous for a sample of limited amount.

In another mode of the present invention, the ion detector is placed after the loop orbit or the reciprocal path, and detects the ions after they have flown the loop orbit or the reciprocal path a predetermined turns. In this case, the ions should be ejected from the ion source every time they are detected by the detector, and every ejection of the ions yields only one length of flight time of a predetermined number of turns. Thus plural ejections are necessary to construct a flight time spectrum. But this method has the advantage of high sensitivity in determining the mass to charge ratio of ions, and is suitable for a quantitative analysis.

In the TOF-MS of the present invention, the measured lengths of flight time are converted to frequency by the Fourier transformation, and the mass to charge ratio of ions is calculated from the frequency. This facilitates separating ions of different mass to charge ratios which reveal mixed peaks in the flight time spectrum, and enables determination of the mass to charge ratio at high accuracy. Especially in the case where the deviation in the flight time due to deviation in the initial kinetic energy becomes smaller, the peaks in the flight time spectrum becomes acute, and the frequency peak in the Fourier transformation becomes also acute. This improves the calculation accuracy of the mass to charge ratio of ions.

DETAILED DESCRIPTION OF A PREFERRED EMBODIMENT

Figure 1:
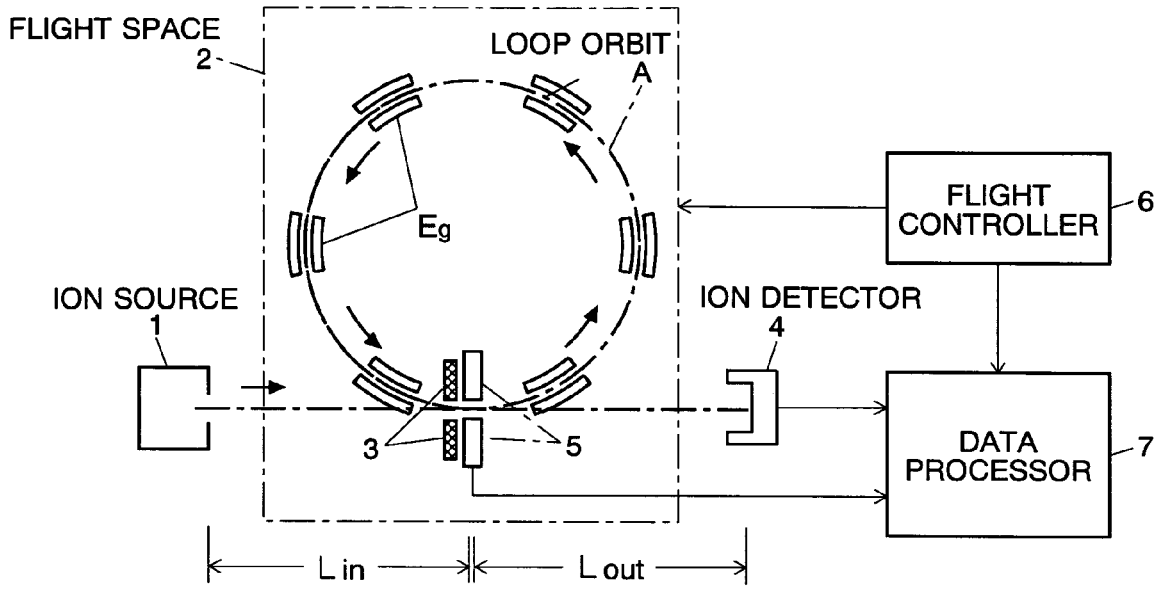
FIG. 1 is a schematic structure of a TOF-MS of an embodiment of the present invention.
Figure 5:
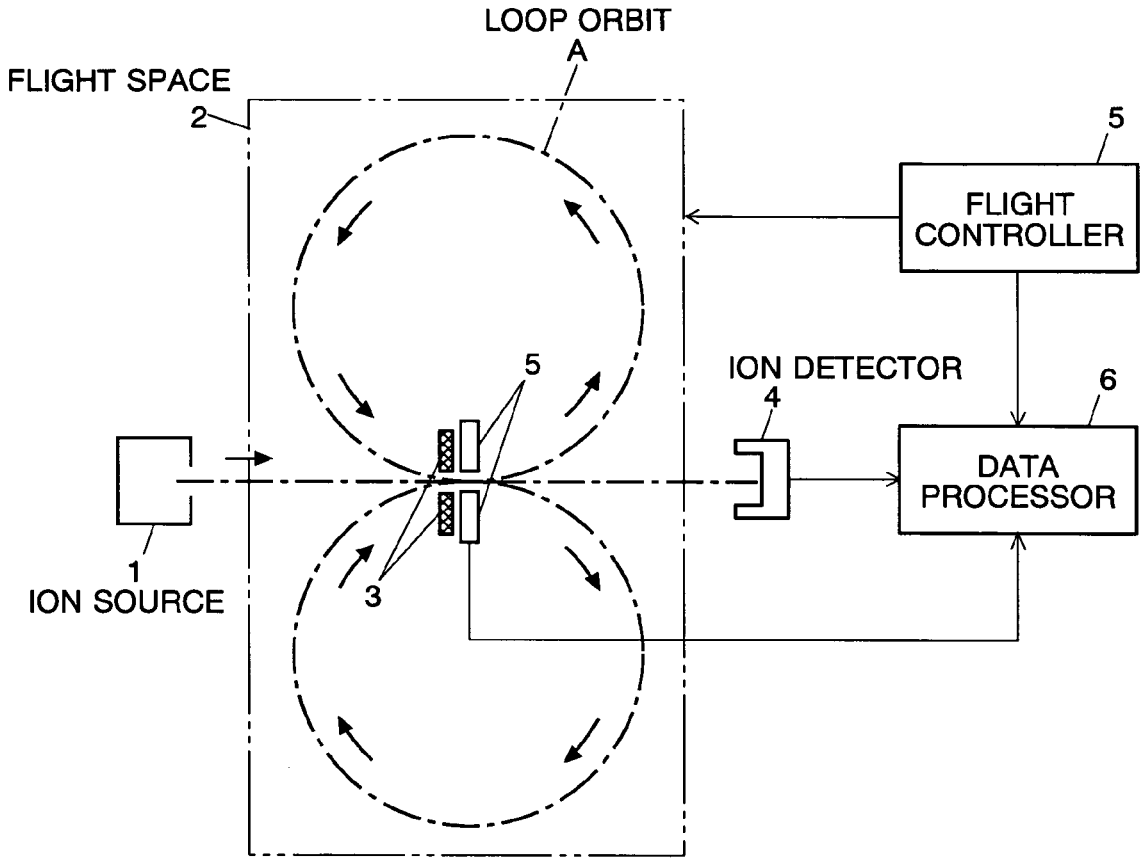
FIG. 5 is a schematic structure of a TOF-MS using a loop orbit figured "8".
Figure 6:
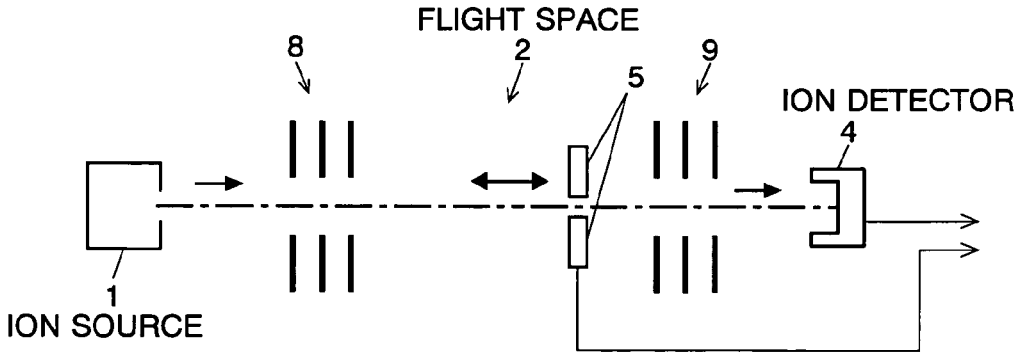
FIG. 6 is a schematic structure of a TOF-MS using a reciprocal ion flying path.

A TOF-MS embodying the present invention is described using FIG. 1. Though the TOF-MS of FIG. 1 has a circular orbit, the present invention is also applicable to an elliptic orbit, an "8" figured orbit as shown in FIG. 5, and any other loop orbit. The present invention is even applicable to TOF-MSs having a straight flight path on which ions reciprocate more than once between the entrance and exit electrodes 8 and 9 as shown in FIG. 6.

In the TOF-MS of FIG. 1, ions starting from the ion source 1 are introduced in the flight space 2, where they are guided by the gate electrodes 3 to the loop orbit A. Ions fly the loop orbit A once or more than once, leave it, exit the flight space 2, and arrive at and are detected by the first ion detector 4. On the loop orbit A is provided another ion detector (second ion detector) 5.

The first ion detector 4 uses a general ion detector of the destructive type, e.g., a photomultiplier, used in conventional TOF-MSs in which ions are not preserved. The second ion detector 5, on the other hand, is the non-destructive type which generates an electric signal corresponding to the amount of electrically charged particles, i.e., ions, passing through it making use of the electromagnetic induction by the charged particles. The destructive type ion detectors generally have highly sensitivity, while the non-destructive type ion detectors generally have low sensitivity. The signals generated by the first and second ion detectors 4, 5 are sent to the data processor 7, where the signals are digitized and various data processings are done, including the calculation of mass to charge ratio of ions.

In the flight space 2, the movement of the ions flying the loop orbit A is controlled by the guide electrodes Eg placed along the loop orbit A, which are applied an appropriate voltage to guide ions. The flight controller 6 supplies driving power to the electrodes in the flight space 2 including the gate electrode 3 and the guide electrodes (E1 or E2), whereby the flight controller 6 can determine the number of turns that the ions fly before they leave the loop orbit A. When an ion is detected by the ion detector, non-destructively or destructively, the flight time measurer measures the length of flight time of the ion, where the length of flight time is from the time point when the ion is ejected from the ion source and to the time point when the ion is detected by the ion detector. For the ion source 1, various conventional ion sources including an ion trap, a MALDI (Matrix-assisted Laser Desorption Ionization) type ion source, etc. can be used.

In conventional TOF-MSs, the length of time from the time point when an ion start the ion source 1 to the time point when it reach the first ion detector 4 after it fly the loop orbit A once or more than once is measured, and the mass to charge ratio of the ion is calculated based on the length of time (flight time). In the TOF-MS of the present embodiment, on the other hand, the mass to charge ratio of the ion is calculated by a different method using the signal from the first ion detector 4, that from the second ion detector 5, or both.

The method used in the TOF-MS of the present embodiment is described as follows. The symbols used in FIG. 1 mean as follows:

Lin: distance from the ion source 1 to the entrance of the loop orbit A

Lout: distance from the exit of the loop orbit A to the first ion detector 4

U: kinetic energy of an ion

C(U): flight length of a turn of the loop orbit A (or the circumference of the loop orbit A)

m: mass to charge ratio of an ion

TOF(m,U): length of flight time of an ion having mass to charge ratio m and kinetic energy U V(m,U): speed of an ion having mass to charge ratio m and kinetic energy U N: number of turns an ion flies the loop orbit A T0: error in the length of flight time caused by jitters in the measuring system and other factors From the working principle of the TOF-MS, the following equation (1) is derived.

$$TOF(m,U)=Lin/V(m,U)+N\cdot C(U)/V(m,U)+Lout/V(m,U)+T0 \quad (1)$$

Figure 2A:
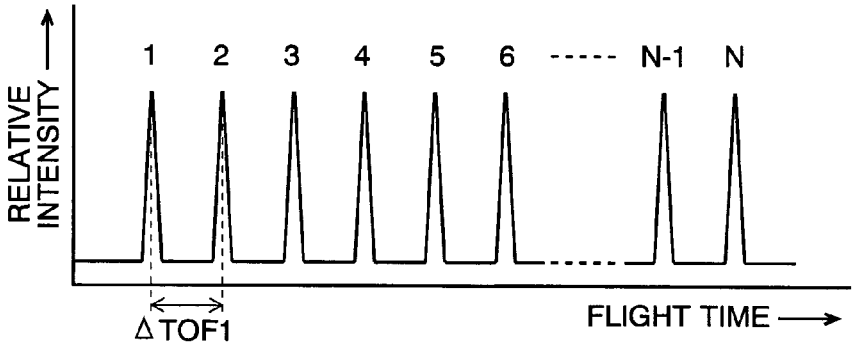
FIG. 2A is a graph of a flight time spectrum of ions of the same mass to charge ratio.

It is supposed here that an ion ejected from the ion source 1 is made to fly the loop orbit A N turns. As the ion flies the loop orbit A one turn, it passes the second ion detector 5, so that the data processor 7 can make a flight time spectrum of an ion having the mass to charge ratio m1 as shown in FIG. 2A based on the signal from the second ion detector 5. In the flight time spectrum, a peak appears for every turn of the ion on the loop orbit A. From equation (1), the lengths of flight time at first to Nth turns can be calculated as follows.

$$TOF1(m,U)=Lin/V(m,U)+C(U)/V(m,U)+Lout/V(m,U)+T0$$

$$TOF2(m,U)=Lin/V(m,U)+2\cdot C(U)/V(m,U)+Lout/V(m,U)+T0$$

$$TOFN(m,U)=Lin/V(m,U)+N\cdot C(U)/V(m,U)+Lout/V(m,U)+T0$$

By adding these equations, the flight time spectrum as shown in FIG. 2 is obtained.

Figure 2B:
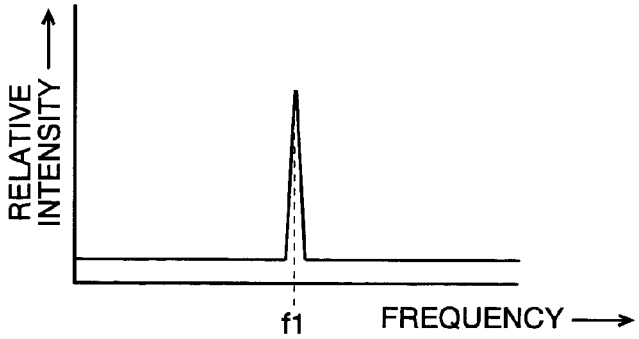
FIG. 2B is a graph of its Fourier transformation.

Even if there is a deviation in the initial kinetic energy of ions of the same mass to charge ratio, the deviation in the length of flight time becomes smaller while the ions continue to fly the loop orbit A, and the time distance ΔTOF1 between the peaks of the flight time spectrum of FIG. 2A, which is the length of time an ion fly the loop orbit A one turn, becomes almost constant. Thus the flight time spectrum can be regarded as a cyclic signal wave of a frequency f. By computing the Fourier transformation of the flight time spectrum, the frequency f [Hz] of the flight time spectrum is obtained, as shown in FIG. 2B. The ion corresponding to the frequency f has the mass to charge ratio such that flies the loop orbit A f turns in a second. That is, $$f(m)\cdot C(U)=V(m).$$

Using the equation, $$m=2U/V(m,U)^2=2U/\{f\cdot C(U)\}^2 \quad (2)$$

is obtained. This shows that the mass to charge ratio m can be calculated by the equation (2) if the kinetic energy U is determined. Practically, this method is used as follows. First, ions of known mass to charge ratios are made to fly the loop orbit A, and the signals from the second ion detector 5 are analyzed as described above. The results are used to calibrate the conversion equation from the frequency to the mass to charge ratio.

Figure 3A:
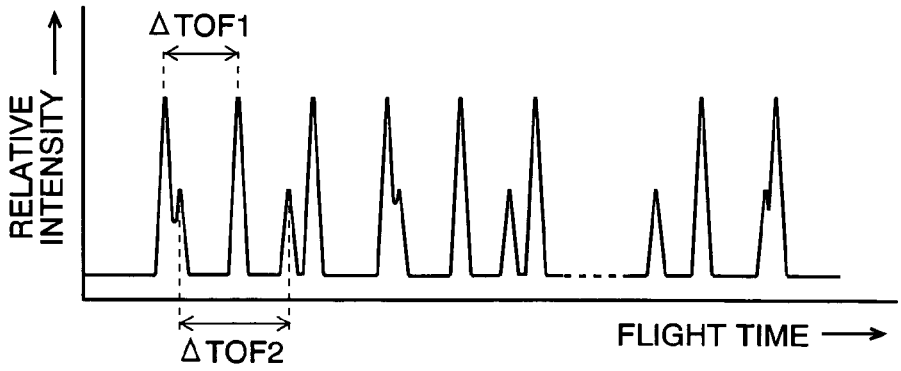
FIG. 3A is a graph of a flight time spectrum of mixed ions including two mass to charge ratios.
Figure 3B:
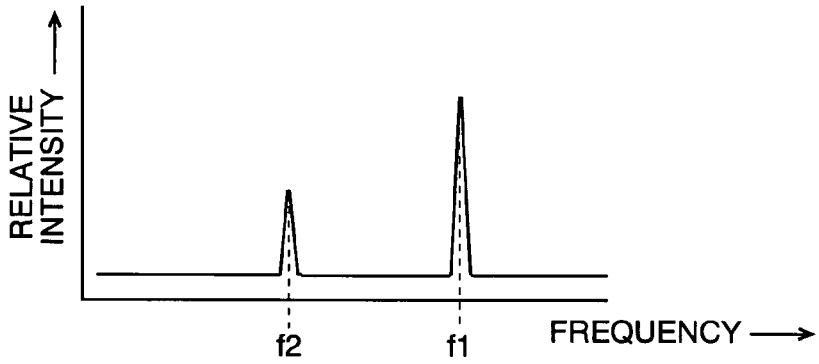
FIG. 3B is a graph of its Fourier transformation.

The graph of FIG. 2A shows the case where only ions of the same mass to charge ratio m1 exist. When ions of mass to charge ratio m2 are mixed to the ions of m1, the flight time spectrum becomes as shown in FIG. 3A, where peaks of different frequencies are mixed, because the flight time of one turn differs between them. If ions of still different mass to charge ratios are further mixed, many different peaks are mingled in the flight time spectrum. In these cases, however, by computing the Fourier transformation of the flight time spectrum, the peaks appear at appropriate frequencies as shown in FIGS. 2B and 3B, and mass to charge ratios corresponding to the frequency peaks can be calculated.

As described before, the condition of the above calculation is that the deviation in the length of flight time becomes smaller while the ions continue to fly the loop orbit A. In the case of such TOF-MSs that ions fly on a loop orbit, the deviation in the flight time due to deviation in the initial kinetic energy of ions becomes smaller; i.e., the condition is almost always satisfied. This is explained in the above cited Japanese Unexamined Patent Publication Nos. H11-135061 and H11-195398.

Thus in the TOF-MS of the present embodiment, the mass to charge ratio of an object ion can be obtained at high accuracy by using the detection signal from the second ion detector 5, and by computing the Fourier transformation of the flight time spectrum constructed from the detection signal.

Similar analysis can be made using the detection signal from the first ion detector 4. In this case, however, only one flight time can be measured for one ejection of ions from the ion source 1. So that the measurements should be made N times to obtain the every length of flight time from first to Nth turn of the loop orbit A. The flight controller 6 controls the gate electrode 3 and other electrode around the loop orbit A to make ions fly the loop orbit A 1 to N times at every analysis. The data processor 7 constructs the flight time spectrum using the signals generated by the first ion detector 4 from the first to Nth turns.

Figure 4:
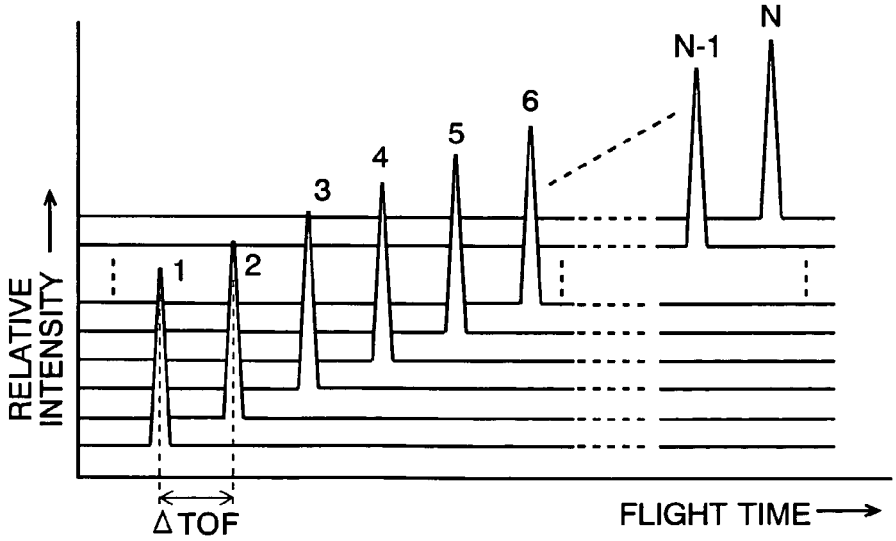
FIG. 4 is a graph of overlapped flight time spectrums obtained through repeated ejections of ions.

For example, the signals generated by the first ion detector 4 for ions of mass to charge ratio m1 flying the loop orbit A from one to N turns are as shown in FIG. 4. By adding these signals, the spectrum as shown in FIG. 2A is obtained, and the Fourier transformation as described above and as shown in FIG. 2B can be computed. Of course the method can be applicable in the case where ions of plural mass to charge ratios are mixed. The advantage of using the first ion detector 4 is that the detection sensitivity is high. In the case of non-destructive ion detector such as that used for the second ion detector 5, it is difficult to enhance the detection sensitivity, and the height of the peaks of the flight time spectrum as shown in FIG. 2A is low. This is especially disadvantageous when a quantitative analysis is required. Using the first ion detector 4, or the destructive type ion detector, adequate signal strengths can be obtained for conducting a quantitative analysis.

For the second ion detector 5, instead of the non-destructive type ion detector as described above, the semi-destructive type ion detector can be used. For example, the hole type Micro Channel Plate (MCP) consumes a small amount of ions at every turn. In this case, the number of turns is limited, but the sensitivity is high, so that the measurement time can be reduced.

The above-described embodiment is only an example, and it is obvious for those skilled in the art to modify it or add unsubstantial elements to it within the scope of the present invention.

What is claimed is:

1. A time of flight mass spectrometer (TOF-MS) comprising:

a flight space containing a loop orbit on which an ion flies;

a flight controller for making an ion fly the loop orbit a predetermined number of turns;

an ion detector for detecting an ion flying or having flown the loop orbit;

a flight time measurer for measuring a length of flight time of ions at or after every turn; and a data processor for constructing a spectrum of flight time, for computing a Fourier transformation of the spectrum, and for determining the mass to charge ratio of the ions based on a frequency peak appearing in the Fourier transformation.

2. The TOF-MS according to claim 1, wherein the ion detector is placed on the loop orbit to detect a flying ion, and the flight time measurer measures the length of flight time at every turn.

3. The TOF-MS according to claim 1, wherein the ion detector is placed after the loop orbit to detect an ion having flown the loop orbit, and the flight time measurer measures the length of flight time every time ions are ejected, fly the loop orbit a predetermined turns, exit the loop orbit and are detected by the ion detector.

4. The TOF-MS according to claim 1, wherein the loop orbit is circular.

5. The TOF-MS according to claim 1, wherein the loop orbit is figured "8".

6. A time of flight mass spectrometer (TOF-MS) comprising:

a flight space containing a reciprocal path on which ions fly;

a flight controller for making an ion fly the reciprocal path a predetermined number of turns;

an ion detector for detecting an ion flying or having flown the reciprocal path;

a flight time measurer for measuring a length of flight time of ions at or after every turn; and a data processor for constructing a spectrum of flight time, for computing a Fourier transformation of the spectrum, and for determining the mass to charge ratio of the ions based on a frequency peak appearing in the Fourier transformation.

7. The TOF-MS according to claim 6, wherein the ion detector is placed on the reciprocal path to detect a flying ion, and the flight time measurer measures the length of flight time at every turn.

8. The TOF-MS according to claim 6, wherein the ion detector is placed after the reciprocal path to detect an ion having flown the reciprocal path, and the flight time measurer measures the length of flight time every time ions are ejected, fly the reciprocal path a predetermined turns, exit the reciprocal path and are detected by the ion detector.

9. A method of determining a mass to charge ratio of ions in a TOF-MS comprising steps of:

making an ion fly a loop orbit or a reciprocal path a predetermined number of turns;

detecting the ion flying or having flown the loop orbit or the reciprocal path;

measuring a length of flight time of an ion or ions of a same mass to charge ratio at or after every turn;

constructing a spectrum of flight time from the measured lengths of flight time;

computing a Fourier transformation of the spectrum; and determining the mass to charge ratio of the ions based on a frequency peak appearing in the Fourier transformation.

10. The mass to charge ratio determining method according to claim 9, wherein the length of flight time is measured at every turn while the ion is flying the loop orbit or the reciprocal path.

11. The mass to charge ratio determining method according to claim 9, wherein the length of flight time is measured every time ions are ejected, fly the loop orbit or the reciprocal path a predetermined turns, exit the loop orbit or the reciprocal path and are detected by the ion detector.

* * * * *